US006824413B1

(12) United States Patent
Shipe et al.

(10) Patent No.: US 6,824,413 B1
(45) Date of Patent: Nov. 30, 2004

(54) ELECTRICAL CONNECTOR WITH RETENTION MECHANISM

(75) Inventors: Joanne E. Shipe, Harrisburg, PA (US); Iosif R. Korsunsky, Harrisburg, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/652,628

(22) Filed: Aug. 28, 2003

(51) Int. Cl.[7] ..... H01R 13/62
(52) U.S. Cl. ..... 439/326; 439/157
(58) Field of Search ..... 439/326, 327, 439/328, 155, 157, 160, 636, 153, 152, 154, 158, 156

(56) References Cited

U.S. PATENT DOCUMENTS 4,872,853 A * 10/1989 Webster ..... 439/327
5,429,523 A * 7/1995 Tondreault ..... 439/157
6,368,124 B1 4/2002 Wang

* cited by examiner

*Primary Examiner*—Alex Gilman
(74) *Attorney, Agent, or Firm*—Wei Te Chung

(57) ABSTRACT

An electrical connector (1) includes an elongate dielectric housing (2) defining a slot (200) along a longitudinal direction thereof, a number of contacts (3) retained in the housing for electrically engaging with an electronic card (5) and a retention mechanism (4) located at one end of the housing. The retention mechanism includes a pair of resilient arms (46) extending along a first direction parallel to the longitudinal direction and a pair of legs (42) extending along a second direction substantially perpendicular to the first direction. The pair of legs are spaced from each other to define a channel (420) therebetween and adapted for receiving a latching projection (54) of the electronic card. The resilient arms are deflectable along the second direction while the legs are deflectable along the first direction.

25 Claims, 6 Drawing Sheets

ELECTRICAL CONNECTOR WITH RETENTION MECHANISM

BACKGROUND OF THE INVENTION

1. Field of the Invention

The present invention relates to an electrical connector, and particularly to an edge card connector with a retention mechanism for securely retaining an inserted card therein.

2. Description of Related Art

Edge card connectors, such as Peripheral Component Interconnect (PCI) connectors are widely used in the computer industry ranging from servers to workstations, personal computers (PCs), laptop PCs and mobile devices. PCI connectors establish a high-performance I/O interconnection between a Central processing unit (CPU) and its peripherals to transfer data therebetween.

PCI Express is a newly developed serial I/O technology compatible with the current PCI software environment that offers low-cost, scalable performance for the next generation of computing and communications platforms. In recent days, PCI Express connectors according to the PCI Express standard are designed to achieve a perfectly high-performance interconnection between two electronic devices, such as a mother printed circuit board and a graphics card.

A conventional PCI Express connector is generally mounted on a mother printed circuit board of a computer to receive a graphics card therein. The connector comprises an elongated dielectric housing defining a card slot along a longitudinal direction thereof and a plurality of terminals located at opposite sides of the card slot. When the graphics card is received in the card slot of the connector, an electrical connection is thus established between the graphics card and the motherboard. However, during transport or shipment of the computer, the connector with the graphics card received therein is subject to high shock loads, which results in the graphics card moving out of the connector. Thus, the electrical connection is adversely affected between the graphics card and the motherboard.

U.S. Pat. No. 6,368,124, assigned to the same assignee (Hon Hai Precision Ind. Co., Ltd.) with this patent application, discloses a solution to add a shroud around the connector. The shroud includes a plastic retainer having a latch projection hooked onto a notch of the graphics card. In an alternative embodiment, the retainer is directly integrated into an insulating housing of the connector. Significantly, forming the retainer integrally with the shroud or the housing complicates the manufacture as well as the operation thereof. To provide sufficient resiliency for easy deflection by the user, the plastic retainer may have a large length. In addition, the graphics card may be sometimes unreliably received in the connector due to wear of the plastic latch projection and/or the latch projection popping out of the notch of the graphics card in high shock load.

Hence, an edge card connector having improved retention mechanism is required to overcome the disadvantages of the related art.

SUMMARY OF THE INVENTION

Accordingly, a first object of the present invention is to provide an edge card connector having an improved retention mechanism for securing an inserted card therein.

A second object of the present invention is to provide an edge card connector having an improved retention mechanism which can be easily manufactured and operated.

In order to achieve the objects set forth, an electrical connector in accordance with the present invention comprises an elongate dielectric housing defining a slot along a longitudinal direction thereof, a plurality of contacts retained in the housing for electrically engaging with an electronic card and a retention mechanism located at one end of the housing. The retention mechanism includes a pair of curved resilient arms abutting against a top face of the housing and a pair of legs spaced from each other to define a channel therebetween adapted for receiving a latching projection of an electronic card. The resilient arms flatten out to move the legs outwardly.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
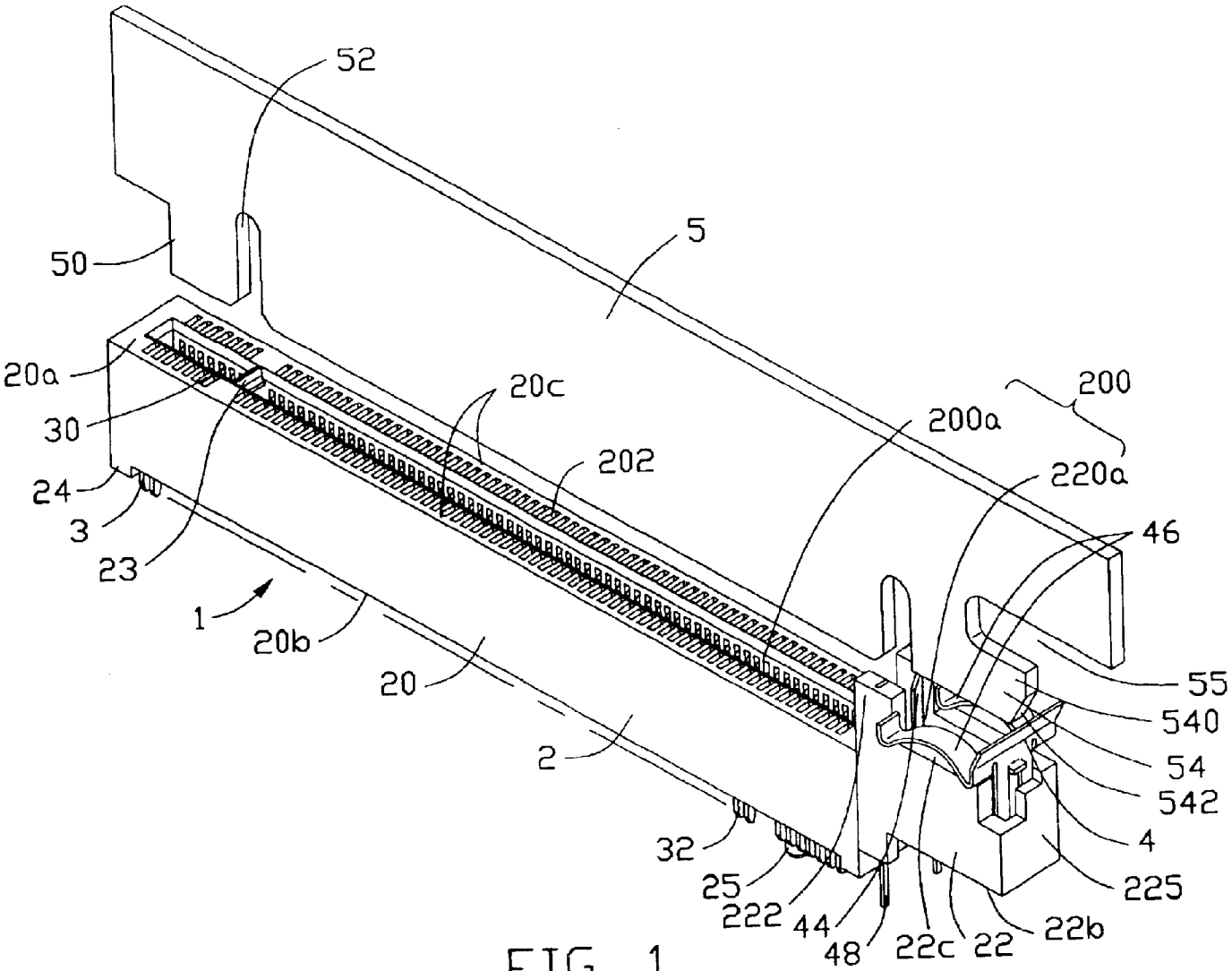
FIG. 1 is a perspective view of an electrical connector in accordance with the present invention and an electronic card to be inserted into the connector, wherein one end of the connector is partially removed for clearly viewing a retention mechanism of the connector.

FIG. 1 illustrates an electrical connector 1 in accordance with the present invention and an electronic card 5 adapted for being received in the connector 1. The electronic card 5 has a mating edge 50 with a plurality of conductive pads (not shown) on opposite sides thereof. A plurality of notches 52 is defined in the mating edge 50. The electronic card 5 is formed with a latching projection 54 at one end thereof and defines a space 55 above the latching projection 54. The latching projection 54 has an engaging portion 540 at a free end thereof and a chamfer 542 below the engaging portion 540.

The connector 1 comprises an elongate dielectric housing 2, a plurality of contacts 3 retained in the housing 2 and a retention mechanism 4 located at one end of the housing 2.

The dielectric housing 2 defines a card slot 200 along a longitudinal direction thereof. In this embodiment of the present invention, the housing 2 is a two-piece configuration including a main housing 20 and an accessory housing 22 attached to one end of the main housing 20. The slot 200 comprises a first slot 200*a* in a top mating face 20*a* of the main housing 20 for receiving the mating edge 50 of the electronic card 5, and a second slot 220*a* in the accessory housing 22 for receiving the latching projection 54 of the electronic card 5. The first slot 200*a* has a width substantially the same as the electronic card 5. The second slot 220*a* has a larger width than the first slot 200*a*.

The housing 2 defines a plurality of first passageways 202 spaced apart along opposite sidewalls 20*c* of the first slot 200*a*. Each first passageway 202 communicates with the first slot 200*a*.

Figure 5:
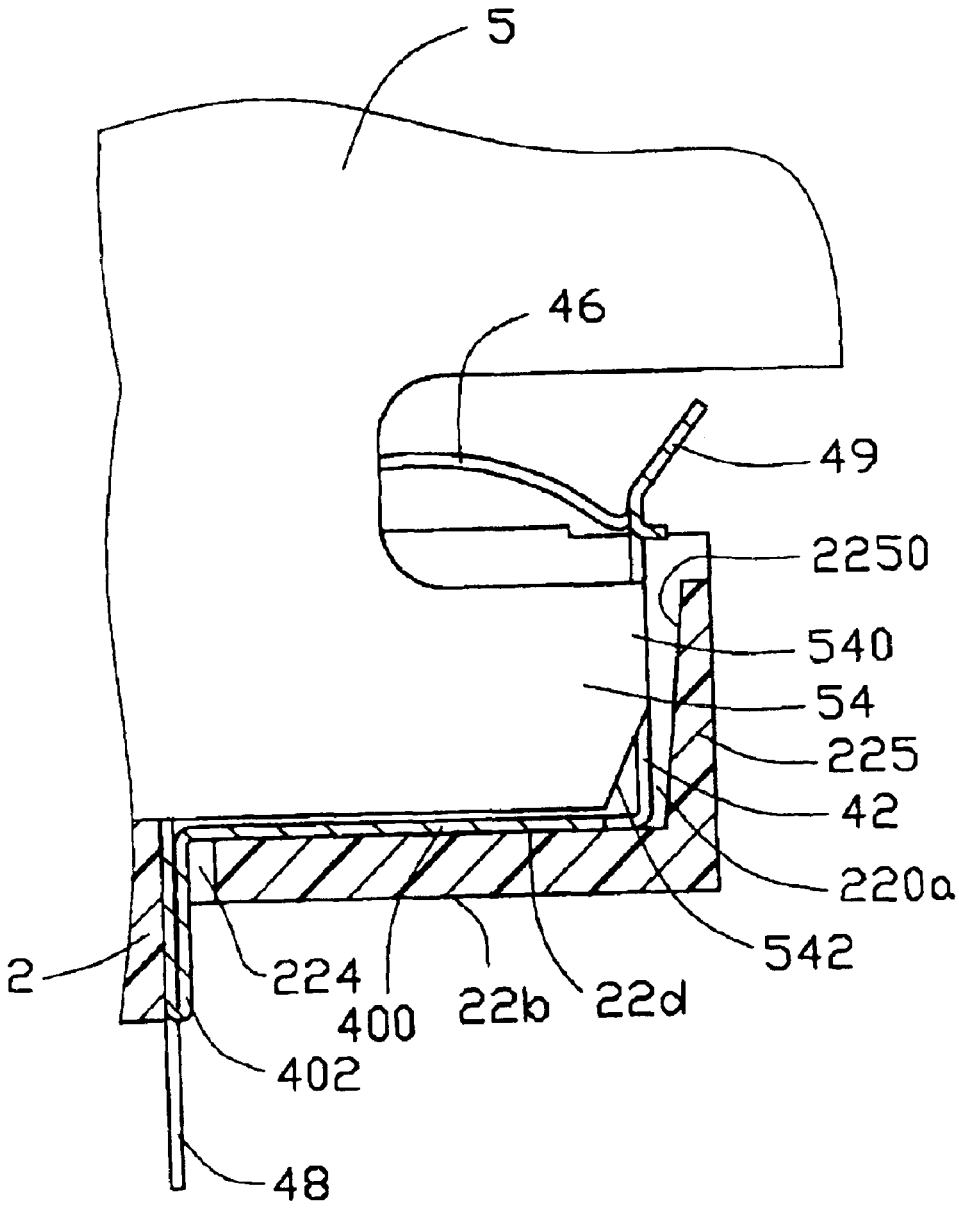
FIG. 5 is a partial cross-section view showing the electronic card securely retained in the connector by the retention mechanism.

Referring to FIG. 5 in conjunction with FIG. 1, the accessory housing 22 includes a pair of sidewalls 22*c* spaced by the second slot 220*a* and a pair of supports 222 located adjacent the main housing 20. Each support 222 defines a recess 223 (shown in FIG. 6) adjacent the sidewall 22*c* in a face 222*a* (FIG. 2) thereof. The accessory housing 22 defines a second passageway 224 extending from a bottom face 22*b* thereof into the supports 222 to form a pair of slits (not labeled) therein. The accessory housing 22 further includes an end wall 225 having an oblique inner face 2250.

The housing 2 is formed with a plurality of ribs 23 in the slot 200. The ribs 23 provide multiple functions such as supporting the sidewalls 20*c* as well as providing polarization for the card 5. A plurality of standoffs 24 projects downwardly from a bottom mounting face 20*b* of the housing 2 for a predetermined distance to space the housing 2 from a mother printed circuit board (not shown) upon placement thereon. A positioning post 25 extends downwardly from the bottom face 20*b* of the housing 2 for positioning the connector 1 on the mother printed circuit board.

The contacts 3 are received in the first passageways 202 of the housing 2. Each contact 3 includes a contact portion 30 extending into the slot 200 for electrically engaging with the mating edge 50 of the card 5, and a solder portion 32 extending downwardly beyond the bottom face 20*b* of the housing 2 for electrically connecting to the mother printed circuit board.

Figure 4:
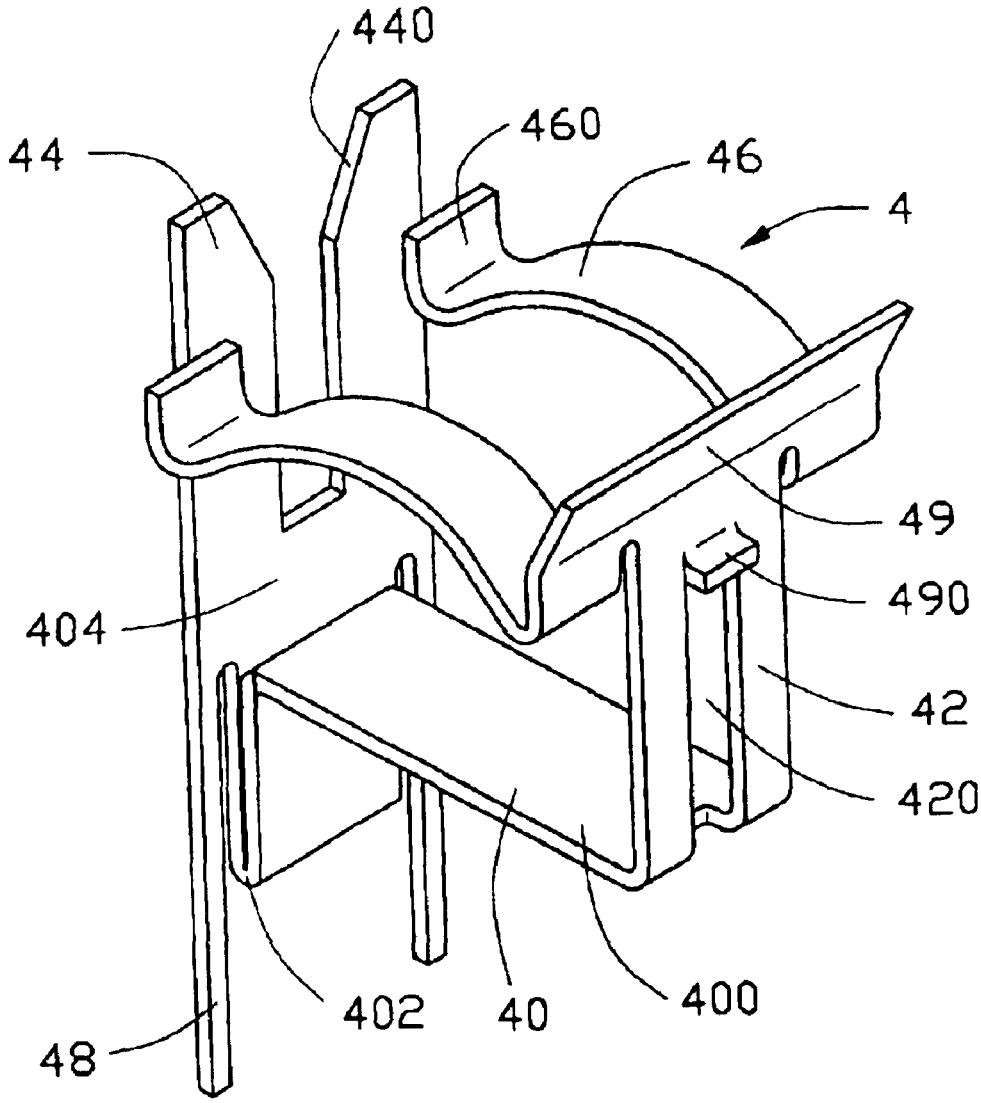
FIG. 4 is an enlarged perspective view of the retention mechanism.

Referring to FIG. 4 in conjunction with FIG. 1, the retention mechanism 4 is received in the second passageway 224 of the accessory housing 22. The retention mechanism 4 is formed from a metal sheet and includes a main body 40, a pair of spaced legs 42 extending upwardly from one end of the main body 40, a pair of mating arms 44 extending upwardly from an opposite end of the main body 40, and a pair of spaced resilient arms 46 extending from the legs 42 toward the mating arms 44. The main body 40 includes a first horizontal portion 400 connecting with the legs 42, a second vertical portion 404 connecting with the mating arms 44, and a U-shaped intermediate portion 402 connecting with the first and the second portions 400, 404. The retention mechanism 4 further includes a pair of tails 48 extending downwardly from the second portion 404 of the main body 40. The spaced legs 42 define a channel 420 therebetween for receiving the engaging portion 540 of the latching projection 54 of the card 5. The channel 420 has a width substantially the same as the latching projection 54. The mating arms 44 define lead-ins 440 at top ends thereof. The spaced legs 42 and the resilient arms 46 are interconnected by a connecting portion 49. A tab 490 extends outwardly from the connecting portion 49 and is located between the legs 42. Each resilient arm 46 is generally of a curved shape and has an upwardly extending abutment 460 at a free end thereof. It is noted that the tails 48 can be used just for holding the connector 1 on the mother printed circuit board without any electrical connection therebetween.

The retention mechanism 4 is assembled to the accessory housing 22 from a top thereof. The first portion 400 of the main body 40 abuts against a bottom face 22*d* of the second slot 220*a*, and the second portion 404 and the intermediate portion 402 of the main body 40 are received in the second passageway 224. The pair of mating arms 44 is received in the slits of the supports 222 and partially extends into the second slot 220*a*. The legs 42 are received in the second slot 220*a* and disposed adjacent the end wall 225. The resilient arms 46 abut against top faces 22*e* of the sidewalls 22*c* of the accessory housing 22. The abutments 460 of the resilient arms 46 are received in the recesses 223 of the supports 222 to have an engagement between the housing 2 and the retention mechanism 4. It is noted that the engagement between the housing 2 and the retention mechanism 4 can be achieved by other manners, for example, each of the side walls 22*c* of the housing 2 defines a cavity and each of the resilient arms 46 of the retention mechanism 4 is folded with a tab extending into the cavity of the housing 2.

Figure 2:
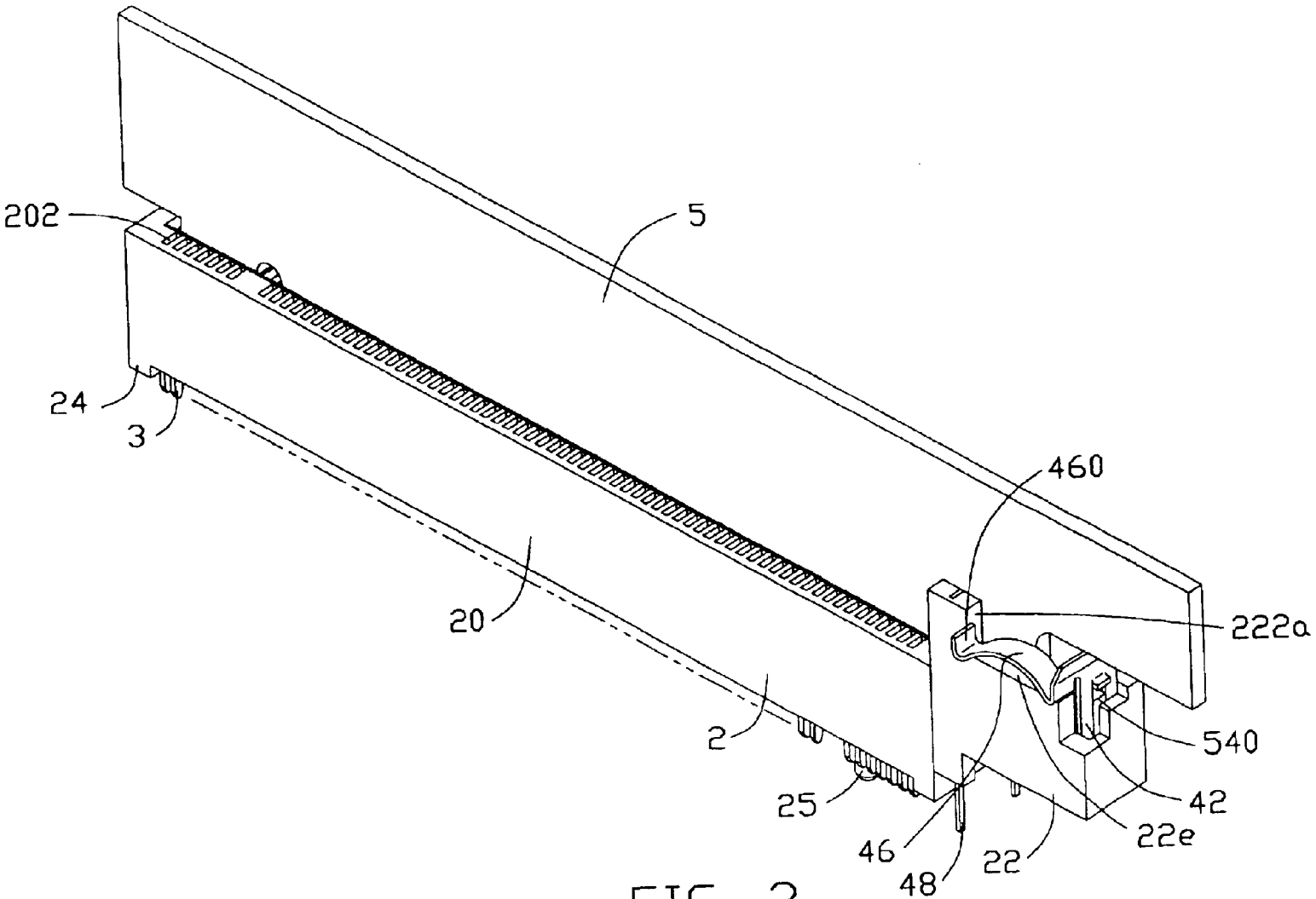
FIG. 2 is a perspective view showing the electronic card received in the connector and the retention mechanism in a closed position.

Referring to FIGS. 2 and 5, the electronic card 5 is received in the slot 200 of the housing 2 with the mating edge 50 electrically connecting with the contact portions 30 of the contacts 3. The ribs 23 of the housing 2 are received in the notches 52 of the card 5. The engaging portion 540 of the latching projection 54 is received in the channel 420 and is securely retained between the legs 42 of the retention mechanism 4 for restricting the card 5 from moving out of the connector 1. The mating arms 44 resiliently abut against opposite sides of the card 5 for preventing a lateral movement of the card 5. Thus, the card 5 is securely received in the slot 200 of the housing 2. The resilient arms 46 are located at opposite sides of the card 5 with the abutments 460 received in the recesses 223 of the supports 222. The connecting portion 49 is accommodated in the space 55 of the card 5.

Figure 3:
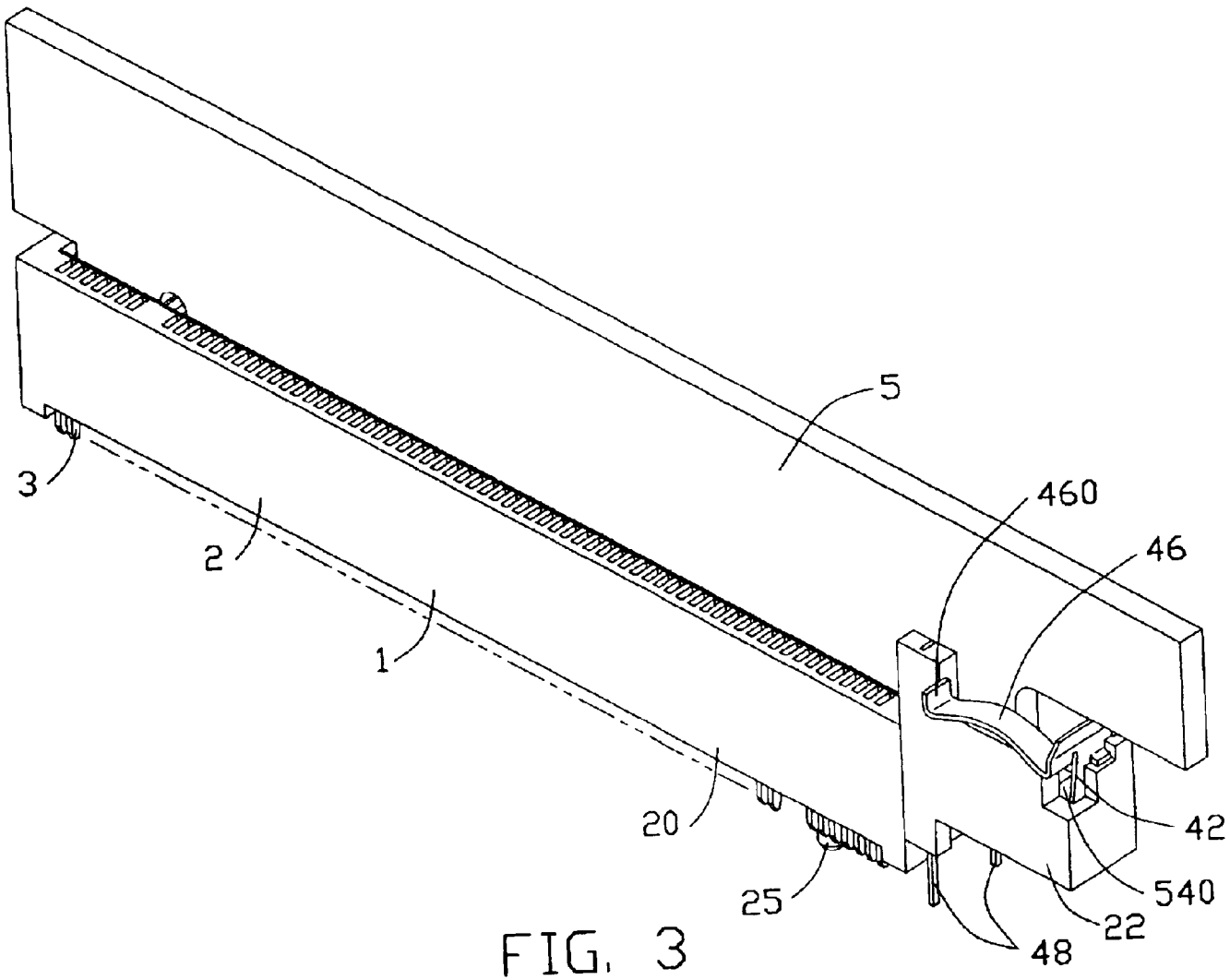
FIG. 3 is a view similar to FIG. 2 but showing the retention mechanism in a released position.
Figure 6:
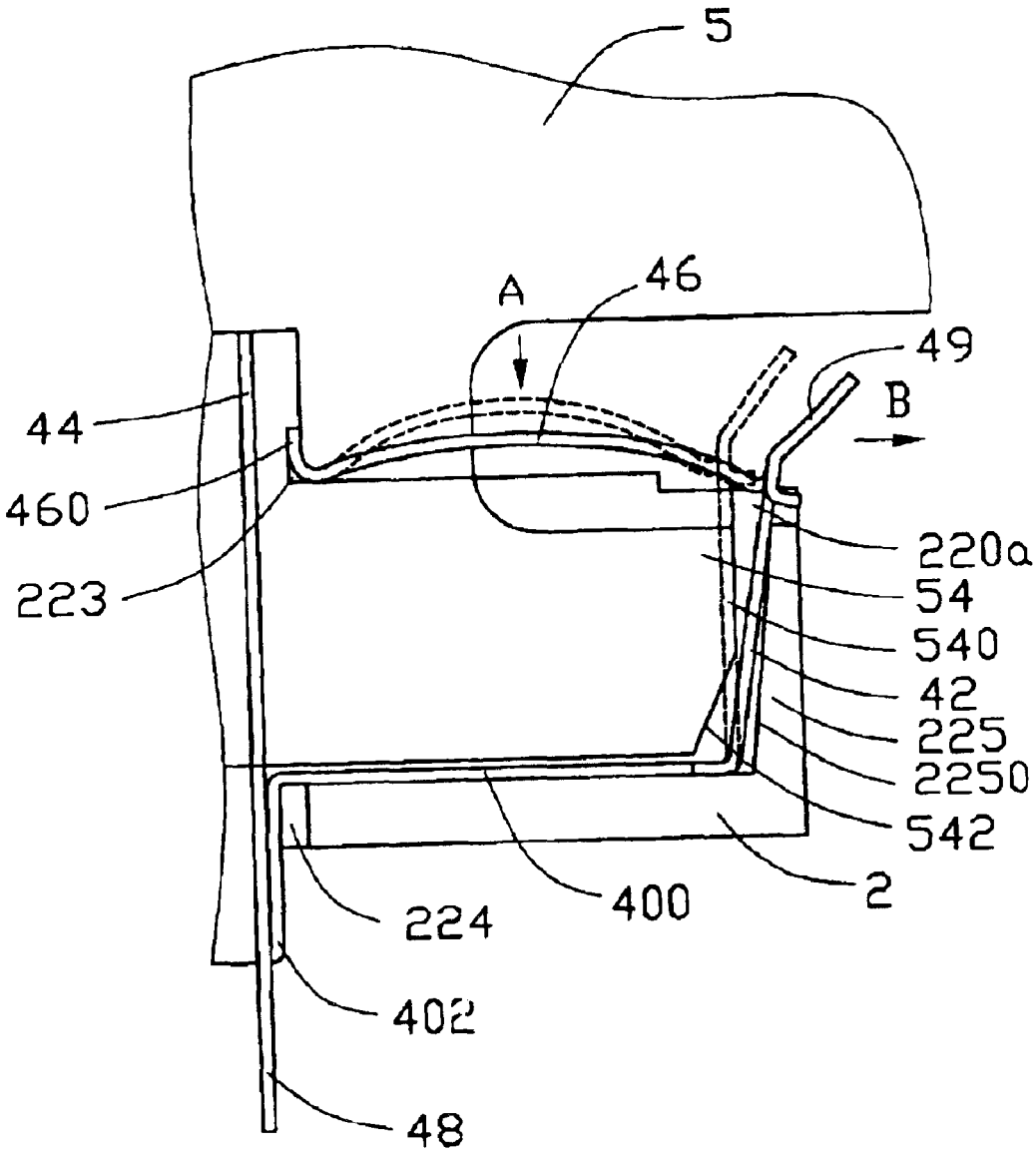
FIG. 6 is a partial plan view of the connector and the electronic card, showing the retention mechanism actuated from the closed position to the released position.

Referring to FIGS. 3 and 6, to remove the card 5 from the connector 1, an external force is downwardly exerted on the resilient arms 46 of the retention mechanism 4 to flatten the resilient arms 46 to actuate the legs 42 to outwardly deflect from a closed position (phantom lines shown in FIG. 6), where the engaging portion 540 of the latching projection 54 is received in the channel 420 and is upwardly blocked by the connection portion 49 (preferably including the tab 490), to a released position (solid lines shown in FIG. 6) where the engaging portion 540 of the latching projection 54 is disengaged from the channel 420. During this procedure, the resilient arms 46 are deflectable in a first direction as illustrated by an arrow A while the legs 42 are deflectable in a second direction as illustrated by an arrow B. Despite of the deflection of the resilient arms 46, the abutments 460 are all the times received in the recesses 223 of the housing 2. The inner face 2250 of the end wall 225 can function as a stop to prevent the legs 42 from over deflection.

During insertion of the card 5 into the slot 200 of the connector 1, the latching projection 54 exerts a load on the connecting portion 49 of the retention mechanism 4 which will actuate the legs 42 to deflect outwardly until they abut against the inner face 2250 of the end wall 225. The card 5 is guided into the slot 200 via the lead-ins 440 of the mating arms 44. Once the card 5 is fully inserted into the slot 200, the pair of legs 42 restore to their closed position where the engaging portion 540 of the latching projection 54 is received in the channel 420 of the retention mechanism 4.

It is noted that the accessory housing 22 can also be integrated into the main housing 20 to form the housing 2 as a one-piece configuration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for engaging with an electronic card, comprising:

an elongate dielectric housing defining a slot in a mating face along a first direction;

a plurality of contacts retained in the housing and comprising contact portions extending into the slot for engaging with the electronic card; and a retention mechanism located at one end of the housing, the retention mechanism comprising at least one curved resilient arm abutting against a top face of the housing and a pair of legs spaced from each other to define a channel therebetween adapted for receiving a latching projection of the electronic card, the at least one resilient arm flattening to move the legs outwardly wherein the housing comprises a pair of supports extending beyond the mating face, and wherein the retention mechanism comprises a pair of mating arms received in the supports and adapted for engaging opposite sides of the electronic card.

2. The electrical connector as claimed in claim 1, wherein the housing is a two-piece configuration and comprises a main housing in which the contacts are retained and an accessory housing at one end of the main housing, the retention mechanism being received in the accessory housing.

3. The electrical connector as claimed in claim 1, wherein the legs are outwardly moveable by flattening the at least one resilient arm along a second direction perpendicular to the first direction.

4. The electrical connector as claimed in claim 3, wherein the housing comprises an end wall having an oblique inner face for preventing the legs from overly moving.

5. The electrical connector as claimed in claim 1, wherein the at least one resilient arm comprises two spaced resilient arms extending from the legs toward the mating arms, the two resilient arms being located at opposite sides of the slot.

6. The electrical connector as claimed in claim 5, wherein the supports define a pair of recesses, and wherein the resilient arms comprises a pair of abutments received in the recesses.

7. The electrical connector as claimed in claim 5, wherein the retention mechanism comprises a main body having a first end from which the legs extend and a second end from which the mating arms extend.

8. The electrical connector as claimed in claim 7, wherein the retention mechanism comprises a tail extending from the main body for connecting to a mother printed circuit board on which the connector is mounted.

9. The electrical connector as claimed in claim 8, wherein the retention mechanism comprises a connecting portion interconnecting the legs with the resilient arms.

10. The electrical connector as claimed in claim 9, wherein the retention mechanism comprises a tab extending outwardly from the intermediate portion and located between the legs.

11. A retention mechanism adapted for being mounted to an electrical connector for securing an electronic card in the connector, comprising:

a main body;

a pair of spaced legs extending upwardly from one end of the main body to define a channel therebetween; and at least one resilient arm extending in a second direction substantially perpendicular to the first direction and comprising a pair of upwardly extending abutments at free ends thereof said retention mechanism further comprising a pair of mating arms extending upwardly from an opposite end of the main body and adapted for contacting with a mating edge of the electronic card, wherein the main body includes a first horizontal portion connecting with the legs, a second vertical portion connecting with the mating arms and a U-shaped intermediate portion interconnecting the first and the second portions.

12. The retention mechanism as claimed in claim 11, wherein the mating arms define a pair of lead-ins at top ends thereof.

13. The retention mechanism as claimed in claim 12, further comprising a pair of tails downwardly extending from the second vertical portion.

14. The retention mechanism as claimed in claim 11, wherein the at least one resilient arm comprises two resilient arms located beside opposite sides of the legs.

15. The retention mechanism as claimed in claim 14, further comprising a connecting portion interconnecting the legs and the resilient arms.

16. An electrical connector assembly, comprising:

a dielectric housing defining a slot with a plurality of contacts arranged at two sides thereof;

an electronic card having a mating edge received in the slot and electrically contacting with the contacts, the electronic card comprising a latching projection at one end thereof; and a retention mechanism located at one end of the housing, the retention mechanism comprising at least one resilient arm located at one side of the electronic card and a pair of spaced legs defining a channel therebetween with the latching projection received therein, the channel having a width substantially the same as the latching projection, the spaced legs being outwardly moveable by deflecting the at least one resilient arm to deflect from a closed position where the latching projection is received in the channel to a released position where the latching projection is disengaged from the channel.

17. The electrical connector assembly as claimed in claim 16, wherein the at least one resilient arm comprise two resilient arms located at opposite sides of the electronic card.

18. The electrical connector assembly as claimed in claim 16, wherein the retention mechanism comprises a pair of mating arms parallel to the legs, the mating arms engaging with opposite sides of the electronic card.

19. The electrical connector assembly as claimed in claim 16, wherein the at least one resilient arm comprises an abutment, and wherein the housing defines a recess receiving the abutment therein.

20. The electrical connector assembly as claimed in claim 19, wherein the housing comprises an end wall having an oblique inner face for preventing the legs form overly moving.

21. The electrical connector assembly as claimed 20, wherein the resilient arm is downwardly deflectable with the abutment received in the recess all the time to allow the legs to move outwardly until the legs abut against the inner face of the end wall.

22. An electrical connector assembly, comprising:

a dielectric housing defining a slot with a plurality of contacts retained at two sides thereof;

an electronic card received in the slot and electrically engaging with the contacts, the electronic card comprising a first connecting portion; and a retention mechanism located at one end of the housing, the retention mechanism comprising at least one resilient arm located at one side of the electronic card and a second connecting portion engaged with the first connecting portion, the at least one resilient arm being deflectable about the abutment in a first direction to actuate the second connecting portion to be deflectable in a second direction, the second direction being substantially perpendicular to the first direction.

23. The electrical connector assembly as claimed in claim 22, wherein the retention mechanism comprises a pair of mating arms engaging with opposite sides of the electronic card.

24. The electrical connector assembly as claimed in claim 23, wherein one of the first and the second connecting portions is a latching projection and another of the first and the second connecting portions is a channel.

25. An electrical connector assembly, comprising:

an insulative housing defining an elongated slot with two rows of terminals by two sides thereof;

a daughter board inserted into the slot, said daughter board defining a notch in a side edge portion and a latch projection under said notch; and a resilient retention mechanism located around an end of said housing, said retention mechanism including a first section invading the notch to prevent upward movement of the daughter board, and a second section located by a transverse side of the daughter board and actuating the first section to move; wherein when the second section is essentially downwardly recoverably moved by a manual force in a first direction, the first section is actuated by said second section to recoverably move along a second direction roughly perpendicular to said first direction to leave from the notch for releasing the daughter board from the housing.

* * * * *